US005917667A

United States Patent [19]

Turner

[11] Patent Number: 5,917,667

[45] Date of Patent: Jun. 29, 1999

[54] HELMET SHIELD MIRROR

[76] Inventor: Philip R. Turner, 10660 Bobwhite Beach, Hamburg, Mich. 48139

[21] Appl. No.: 08/912,438

[22] Filed: Aug. 18, 1997

Related U.S. Application Data

[60] Provisional application No. 60/024,388, Aug. 19, 1996.

[51] Int. Cl.[6] ..... G02B 7/182; A42B 1/24

[52] U.S. Cl. ..... 359/880; 359/883; 351/50; 2/209.14

[58] Field of Search ..... 359/630, 842, 359/849, 871–876, 879, 880, 883; 351/50, 158; 2/209.14, 209.13

[56] References Cited

U.S. PATENT DOCUMENTS

| | | | |
|---|---|---|---|
| 3,501,227 | 3/1970 | Landen | 359/872 |
| 3,515,365 | 6/1970 | Jones et al. | 248/481 |
| 3,804,495 | 4/1974 | Rayow et al. | 359/834 |
| 4,746,206 | 5/1988 | Kusztos et al. | 359/876 |
| 5,076,701 | 12/1991 | Greenlaw | 359/879 |

*Primary Examiner*—Huy Mai
*Attorney, Agent, or Firm*—James M. Deimen

[57] ABSTRACT

A new helmet mirror comprises an articulated two-piece body having the mirror on one piece and an attachment device on the other piece. For most applications the attachment device comprises an adhesive for attachment directly to the clear face shield of a snowmobile helmet. The mirror and the adhesive are on the back of the respective pieces and the fronts of the respective pieces are smoothly contoured to reduce wind resistance and aerodynamic forces applied to the mirror body at high speeds. In an alternative embodiment a third piece comprising a link joins the mirror piece to the attachment piece with two articulation joints. The link is aerodynamically shaped to substantially reduce vibration of the mirror at high speeds and thereby reduce the forces applied to the articulation joints which retain the mirror in the proper viewing position.

10 Claims, 2 Drawing Sheets

HELMET SHIELD MIRROR

This is a complete application based on provisional patent application Ser. No. 60/024,388.

BACKGROUND

The field of the invention pertains to rear view mirrors for viewing behind the driver of a vehicle, and in particular, to mirrors for viewing behind snowmobiles, motorcycles and other vehicles for which the driver wears a helmet.

Mirrors of about three inches or more diameter have been mounted on the handle bars of snowmobiles and motorcycles and are in common use. They are also used on bicycles and other similar vehicles. Much smaller and fragile mirrors have been mounted on the stems of eye glasses for bicyclists, however, their fragile construction does not generally permit their use by snowmobilers and motorcyclists who frequently travel at speeds in excess of 60 MPH. Moreover, for protection at high speeds, snowmobile helmets and motorcycle helmets come equipped with face shields of clear plastic having a double or compound curvature shape. The compound curvatures of the helmet and the face shield do not lend themselves to the attachment of accessories nor do the high impact resistant plastics of the helmet body and face shield.

SUMMARY OF THE INVENTION

The new mirror comprises an articulated two-piece body having the mirror on one piece and an attachment device on the other piece. For most applications the attachment device comprises an adhesive for attachment directly to the clear face shield of a snowmobile helmet. The mirror and the adhesive are on the back of the respective pieces and, in the preferred design the fronts of the respective pieces are smoothly contoured or "streamlined" to reduce wind resistance and therefore aerodynamic forces applied to the mirror body at high speeds. The streamlined design also reduces the aerodynamic forces applied to the articulation joint connecting the two pieces and which retains the mirror in the proper viewing position.

In an alternative embodiment the articulation joint comprises an aerodynamically shaped link with articulation joints at each end. The shaped link provides a larger range of adjustability for the new mirror. The aerodynamic shape substantially reduces vibration of the mirror at high speeds.

DESCRIPTION OF THE PREFERRED EMBODIMENT

Figure 1:
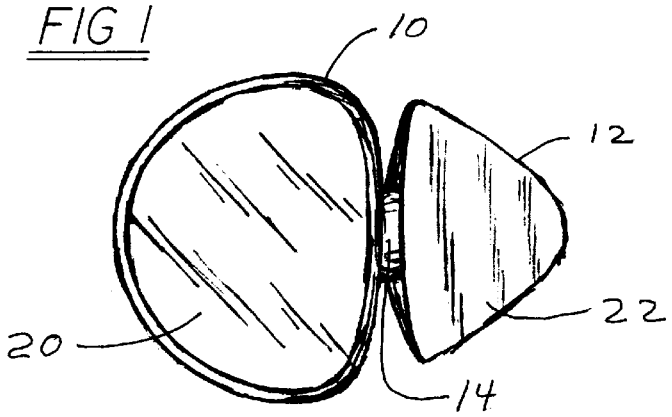
FIG. 1 is a back view of the mirror.
Figure 2:
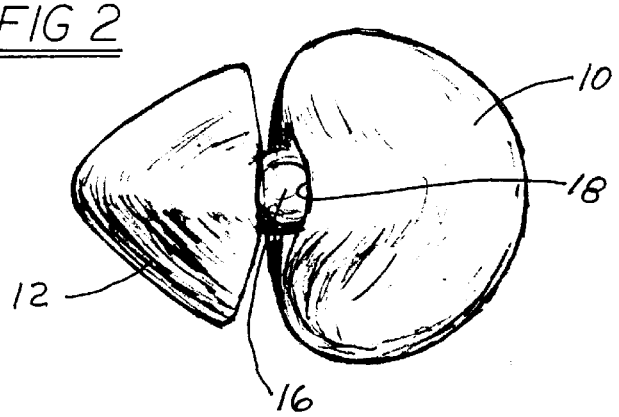
FIG. 2 is a front view of the mirror.

In FIGS. 1 and 2 the mirror comprises a mirror piece 10 and an attachment piece 12 joined by articulation means 14.

The articulation means 14 comprises a stud 16 having a spherical end extending from the attachment piece 12. A socket 18 complementary in shape to the spherical end is formed in the mirror piece 10. The spherical end and socket 18 are formed to provide for a snap fit when the pieces 10 and 12 are assembled together and a slight interference fit upon assembly whereby the engagement of the spherical end and socket 18 provide for strong frictional retention of the relative position between the two pieces 10 and 12. As an alternative a ratcheting device may be incorporated in the articulation means 14 to positively engage and prevent inadvertent relative motion.

The mirror piece 10 includes a mirror 20 permanently attached thereto. The back surface of the attachment piece 12 is formed with a concave shape and includes an adhesive coating 22 on the back surface which may be covered by wax paper or a similar device to protect the adhesive from contact and exposure until the mirror is ready to be installed. The concave shape of the back surface is preferably a compound curvature to match the curvature of a clear plastic face shield 24.

Figure 3:
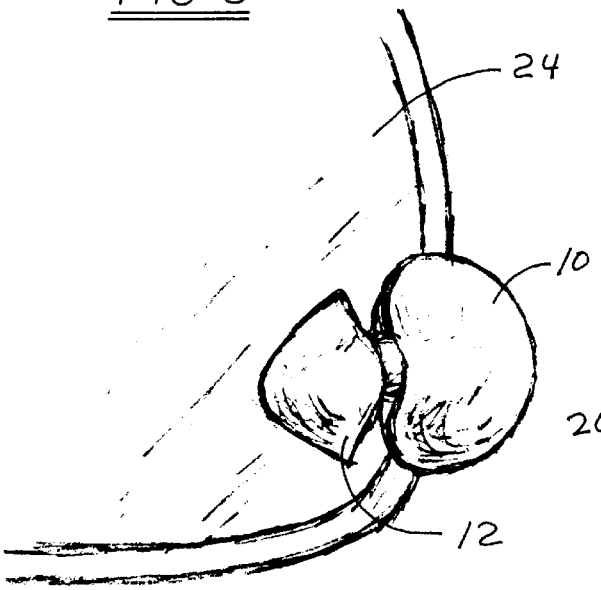
FIG. 3 is a front view of the mirror as installed on a helmet face shield.
Figure 4:
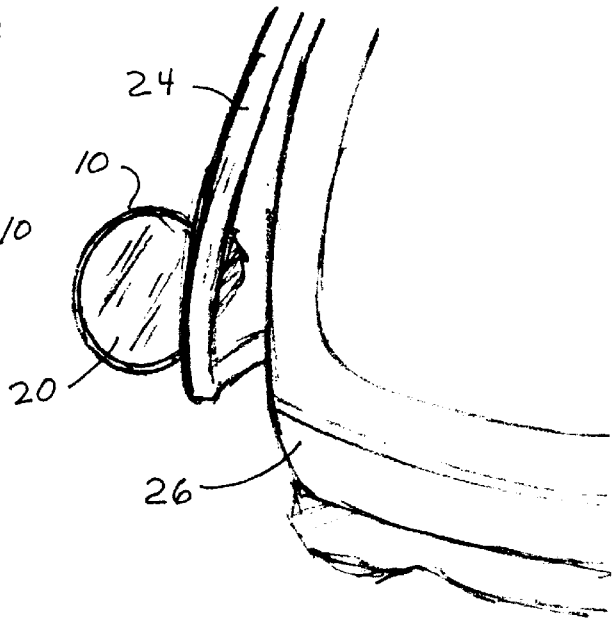
FIG. 4 is a back view of the mirror as installed on a helmet face shield.

The assembled mirror is about two inches in its longest dimension and installed so as to be easily seen by the user without interfering with the user's forward view. As shown in FIGS. 3 and 4 the attachment piece 12 is adhesively affixed to the clear plastic face shield 24 of a snowmobile helmet 26. The attachment piece 12 may be temporarily attached with clear plastic tape until the proper location is ascertained. Then the protective cover on the adhesive 22 may be removed and the mirror permanently affixed to the face shield 24.

Figure 5:
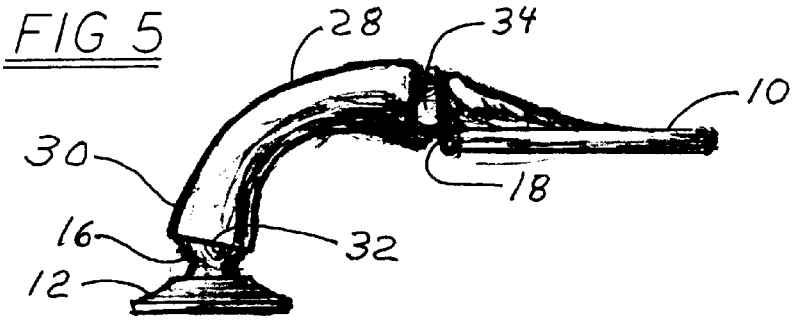
FIG. 5 is a top view of the alternative embodiment of the mirror.
Figure 6:
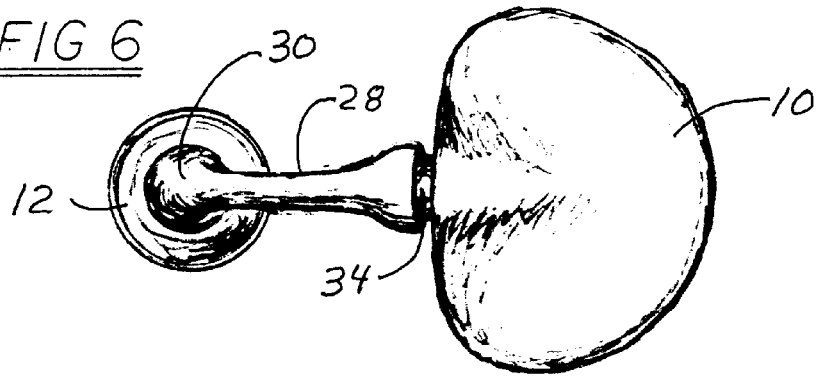
FIG. 6 is a front view of the alternative embodiment of the mirror.

In the alternative embodiment illustrated in FIGS. 5 and 6 a link 28 joins the mirror piece 10 to the attachment piece 12. One end 30 of the link 28 is formed with a socket 32 sized for an interference fit with the spherical ended stud 16 on the attachment piece 12. The other end of the link 28 is formed with a spherically ended stud 34 that engages the socket 18 in the mirror piece 10 with an interference fit.

Figure 7:
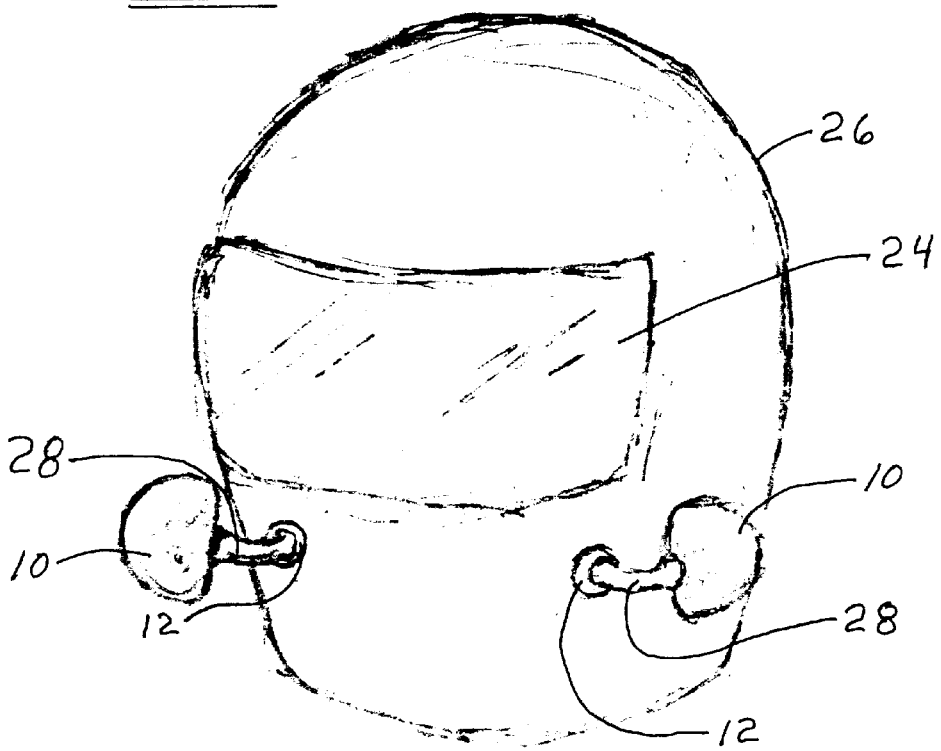
FIG. 7 is a perspective view of a pair of alternative embodiments of the mirror mounted on a helmet.

In FIG. 7 two of the alternative mirror assemblies are shown with the attachment pieces 12 affixed to the helmet 26. The link 28 is aerodynamically streamlined to an airfoil shape to substantially reduce and eliminate vibration of the mirror at high speeds. The airfoil shape is substantially symmetric about a plane defined by the axis extending from each end of the link 28, the link being substantially curved or elbow shaped. Testing at high speeds of a cylindrical curved link in comparison with the airfoil shaped link has shown that noticeable and distracting vibration of the mirror with a cylindrical link is eliminated with the airfoil shaped link shown in FIGS. 5 and 6.

While specifically directed to snowmobile helmets, the new mirror is applicable to motorcycle helmets and other helmets with or without face shields. The mirror may also be affixed to a bracket or equipped with a longer shaped link for applications such as bicycle helmets that do not include face shields.

I claim:

1. A helmet rear view mirror comprising a mirror piece having a smooth contoured aerodynamic forward facing surface and a rearward facing mirror surface, an attachment piece having a smooth contoured aerodynamic forward facing surface and a rearward facing concave surface, an adjustable attachment connecting the mirror piece to the attachment piece, said adjustable attachment including means to prevent inadvertent adjustment absent purposeful manual adjustment, and adhesive means on the rearward facing concave surface, said adhesive means adapted to attach the rear view mirror directly to a portion of a helmet selected by a user.

2. The helmet mirror of claim 1 wherein the rearward facing concave surface is formed with a compound curvature.

3. The helmet mirror of claim 1 wherein said adjustable attachment means to prevent inadvertent adjustment comprise an interference fit spherical ball and socket snap fitable together.

4. The helmet mirror of claim 1 wherein the adjustable attachment includes a link with two ends formed with first means to adjustably attach at a first end to the mirror piece and second means to adjustably attach at the other end to the attachment piece, the link first and second adjustable attachment means each including means to prevent inadvertent adjustment absent purposeful manual adjustment.

5. The helmet mirror of claim 4 wherein the means to prevent inadvertent adjustment comprise an interference fit spherical ball and socket at at least one of the first and second means to adjustably attach.

6. The helmet mirror of claim 4 wherein the link is aerodynamically shaped to substantially reduce vibration of the mirror piece and link.

7. The helmet mirror of claim 4 wherein the link is curved.

8. A helmet rear view mirror comprising a mirror piece having a smooth contoured aerodynamic forward facing surface and a rearward facing mirror surface, an attachment piece having a smooth contoured forward facing surface and a rearward facing concave surface, an adjustable attachment link having a first connection to the mirror piece and a second connection to the attachment piece, said adjustable attachment link including means to prevent inadvertent adjustment absent purposeful manual adjustment, said means to prevent inadvertent adjustment comprising an interference fit spherical ball and socket at at least one of the first and second adjustable attachment link connections to the mirror piece and attachment piece, and adhesive means on the rearward facing concave surface, said adhesive means adapted to attach the rear view mirror directly to a portion of a helmet selected by a user.

9. The helmet mirror of claim 8 wherein the rearward facing concave surface is formed with a compound curvature.

10. The helmet mirror of claim 8 wherein the link is curved and aerodynamically shaped to substantially reduce vibration of the mirror piece and link.

* * * * *